US006219990B1

(12) United States Patent
Snyder et al.

(10) Patent No.: US 6,219,990 B1
(45) Date of Patent: Apr. 24, 2001

(54) METHOD OF MAKING AN IMPROVED HOT ROLLED I-BEAM AND ASSOCIATED PRODUCT

(75) Inventors: Carl A. Snyder, McMurray; Michael A. Karczewski, Beaver Falls; Karl W. Shurskis, Hookstown, all of PA (US); Sunil Saigal, Fairfax, VA (US)

(73) Assignee: J&L Structural, Inc., Aliquippa, PA (US)

( * ) Notice: Subject to any disclaimer, the term of this patent is extended or adjusted under 35 U.S.C. 154(b) by 0 days.

(21) Appl. No.: 09/056,307

(22) Filed: Apr. 7, 1998

(51) Int. Cl.[7] ..... E04C 3/30
(52) U.S. Cl. ..... 52/729.1; 52/729.3
(58) Field of Search ..... 52/729.1, 729.2, 52/729.3, 729.4, 729.5

(56) References Cited

U.S. PATENT DOCUMENTS

| | | |
|---|---|---|
| 101,015 | 3/1870 | Holms . |
| 1,837,088 | 12/1931 | Watson . |
| 1,927,442 | 9/1933 | Laufle . |
| 2,056,563 | 10/1936 | Budd et al. . |
| 2,108,795 | 2/1938 | Budd et al. . |
| 2,246,578 | 6/1941 | Salardi . |
| 2,263,272 | 11/1941 | Moss . |
| 2,392,674 | 1/1946 | Lachman et al. . |
| 2,605,867 | 8/1952 | Goodwin . |
| 3,199,174 | 8/1965 | Nilsson et al. . |
| 3,217,659 | 11/1965 | Ford, Jr. . |
| 3,335,596 | 8/1967 | Noda et al. . |
| 3,810,363 | 5/1974 | Dar Conte . |
| 3,962,763 | 6/1976 | Jury . |
| 4,129,974 | 12/1978 | Ojalvo . |
| 4,251,973 | 2/1981 | Paik . |
| 4,291,564 | 9/1981 | Muckli . |
| 4,433,565 | 2/1984 | Preller . |
| 5,203,183 | 4/1993 | Iguchi et al. . |
| 5,518,208 | 5/1996 | Roseburg . |
| 5,623,845 | 4/1997 | Wilde . |

FOREIGN PATENT DOCUMENTS

| | | |
|---|---|---|
| 58-116901 | 7/1983 | (JP) . |
| 606201 | 1/1985 | (JP) . |
| 63-299801 | 12/1988 | (JP) . |
| 531501 | 2/1993 | (JP) . |

*Primary Examiner*—Christopher T. Kent
*Assistant Examiner*—Jennifer I. Thissell
(74) *Attorney, Agent, or Firm*—Arnold B. Silverman; Eckert Seamans Cherin & Mellott, LLC

(57) ABSTRACT

A method of forming and using a metal I-beam includes hot rolling an elongated metal workpiece to establish a web and a pair of flanges on the edges thereof. The web is formed with elongated reinforcement of solid cross-section having a generally straight longitudinal axis oriented generally parallel to the flanges. The hot rolled I-beam is cooled without forming substantial waves in the web and the I-beam is subsequently secured in a building construction or other structural product. The method involves the longitudinally oriented reinforcing means which preferably are one or more elongated laterally projecting ribs having such mass that the average temperature of the web prior to cooling will be sufficiently close to the average temperature of the flanges prior to cooling that the formation of waves within the web during cooling will be resisted. The reinforcement is preferably coextensive with the I-beam. The web is preferably substantially continuous. A corresponding I-beam and the use of the I-beam in a load bearing position in a building or other structural product are disclosed.

5 Claims, 2 Drawing Sheets

METHOD OF MAKING AN IMPROVED HOT ROLLED I-BEAM AND ASSOCIATED PRODUCT

BACKGROUND OF THE INVENTION

1. Field of the Invention

The present invention relates to a method of making metal I-beams of the type employed in building construction and the associated I-beam and, more specifically, it relates to improved hot rolled metal I-beams which resist the formation of undesired waves in the I-beam web and the method of making the same.

2. Description of the Prior Art

It has long been known to employ various types of metal beams, such as steel I-beams, in building construction of various types. Such beams have a web and a pair of flanges in opposite edges of the web such that the beams may be employed individually or in an assembly of such beams so as to safely support substantial static loads thereon.

It has been known to establish such beams by welding the flanges to the web. It has also been known to form such beams by hot rolling from a billet.

One of the problems which has been encountered with respect to hot roll forming of I-beams has resulted from the bulk distribution causing the web temperature and the flange temperature to be sufficiently different that the web cools faster than the flange thereby resulting in undesirable waves being created in the web due to the differential cooling rate. This temperature differential can, in some instances, equal about 250° F.

U.S. Pat. No. 4,251,973 discloses an I-beam welded to flanges wherein an effort to cure the problem of web waviness due to temperature differential is disclosed. It employs a plurality of hollow corrugations formed within the web extending in a direction generally perpendicular to the longitudinal extent of the I-beam. See, also, German Patent 46414.

It has also been known to suggest providing open trusses for building construction wherein elongated truss ribs are initially formed within the web and are subsequently severed from major portions of the web and deformed to create the expanded open web truss construction. See U.S. Pat. Nos. 1,927,442 and 3,962,763.

U.S. Pat. No. 3,199,174 discloses securing a series of flat strips to the web to resist undesired web buckling "at the manufacture of the beam" and to strengthen the web against buckling caused by external forces.

It has also been known to provide a truss with a plurality of indentations in the web separated by elongated bars.

U.S. Pat. No. 2,263,272 discloses the manufacture of a steel I-beam by welding a web plate to a pair of T-sections.

U.S. Pat. No. 4,129,974 discloses an I-beam having a restraining structure in the form of a local reinforcing member which is generally channel-shaped and secured to the flanges and web at a particular longitudinal position. See, also, U.S. Pat. No. 2,392,674.

Reinforcement of a leading end of a pile member through the use of one or more weld beads is disclosed in U.S. Pat. No. 3,810,363.

In spite of the foregoing disclosures, there remains a real and substantial need for a method of making a metal I-beam by hot rolling without the presence of undesired waves in the web portion and the resultant product, as well as a building construction and other structural products employing one or more such I-beams in a load bearing manner.

SUMMARY OF THE INVENTION

The present invention has solved the above-described problem by providing a method of creating a metal I-beam by hot rolling. An elongated metal workpiece is progressively hot rolled to create an elongated beam having a web and flanges at the edges thereof. Within the web are formed elongated reinforcing means of solid cross-section having a generally straight longitudinal axis oriented generally parallel to the flanges. Cooling of the I-beam is then accomplished while resisting forming of substantial waves in the web. The method contemplates the elongated reinforcing means in a preferred embodiment being about one to five elongated laterally projecting ribs which are preferably continuous and coextensive with the beams. The reinforcing ribs serve as a heat sink to minimize the temperature differential between the web and the flanges during roll forming such that cooling does not create temperature differential induced waves in the web.

In a preferred embodiment the ribs are established with a maximum width of about 200 to 400 percent of the average width of the web and preferably about 275 to 325 percent. The height measured along the web is about 0.5 to 1.5 inches and preferably about 0.75 to 1.25 inches.

The hot rolling is preferably effected sequentially at multiple stations at a temperature of about 1800° F. to 2300° F. for steel I-beams. Prior to cooling, it is common for the temperature of the web be about 85 to 95 percent of the temperature of the flanges.

The I-beam made by the foregoing method has the described construction and is substantially devoid of temperature differential induced waviness in the web.

The resultant beam may be employed in a building as a load bearing member in the same manner as any I-beam could be employed.

It is an object of the present invention to provide a method of hot rolling an I-beam and the resultant product which resists temperature induced waviness in the web portion of the I-beam.

It is a further object of the present invention to provide longitudinally extending reinforcing means integrally formed within the I-beam web which function as a heat sink to minimize temperature differential between the web and flanges during I-beam roll forming.

It is a further object of the present invention to provide such a method of making an I-beam which may be employed with conventional roll forming techniques with rolls appropriately designed to establish the reinforcing means.

It is another object of the present invention to provide such a method and resultant product which may be employed in a conventional manner in load bearing use in building construction.

It is yet another object of the present invention to provide such a method and an associated product which are economical to manufacture and use.

It is yet another object of the invention to provide such an I-beam which has reduced weight per linear foot as compared with standard I-beams while having equal or increased strength.

These and other objects of the invention will be more fully understood from the following description of the invention with reference to the drawings appended hereto.

DESCRIPTION OF THE PREFERRED EMBODIMENTS

As employed herein, the term "building" refers to manufactured homes, modular homes, houses, apartment buildings, commercial buildings, and any other constructions having external walls and a roof secured thereto, wherein I-beams are employed as structural members.

As employed herein, the term "structural product" means products including I-beams as structural members and shall include, but not be limited to buildings, bridges, recreational vehicles, ships, boats, boat trailers, truck trailers and other trailers, and highway guard rails and highway sign posts.

Figure 1:
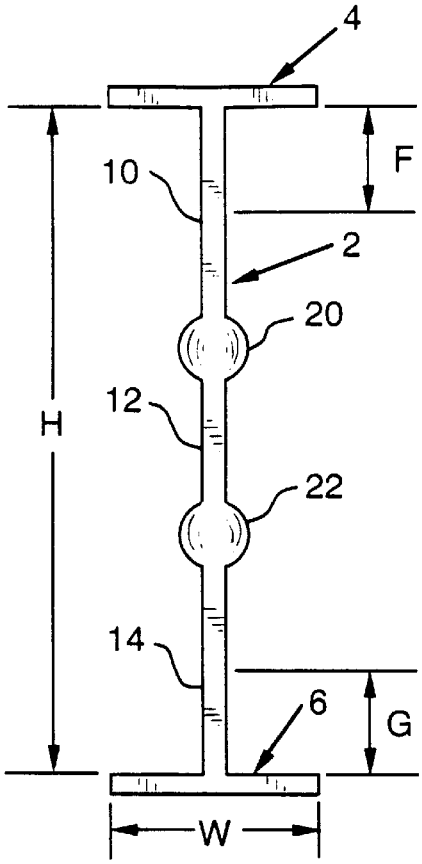
FIG. 1 is an end elevational view of a form of I-beam of the present invention.
Figure 2:
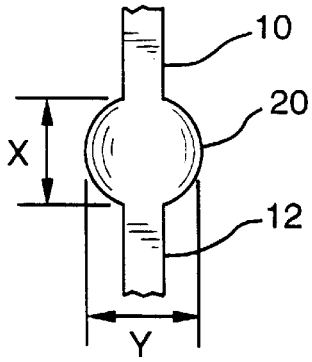
FIG. 2 is a fragmentary illustration showing a portion of the web of the I-beam of FIG. 1.

Referring to FIGS. 1 and 2, there is shown an I-beam of the present invention which has web 2 and a pair of flanges 4, 6 positioned at opposite edges of the web and integrally formed therewith as a result of the I-beam having been formed as a unitary I-beam through progressive hot rolling a metal workpiece. In the preferred embodiment, both the web 2 and the flanges 4,6 are longitudinally substantially coextensive as made and are continuous.

While the I-beam may have any desired proportions, the flanges 4,6 preferably are of equal width W and may, for example, be about 1⅛ to 8 inches wide. If desired, flanges 4,6 may be of different widths. The web 2 may have a height H which may, for example, be about 2 to 24 inches for flanges falling within the recited range. In order to facilitate efficient handling and customize on-site cutting and joining of the I-beams, areas 10,14 of height respectively, F,G, are preferably substantially planar. Values F and G are preferably a minimum of 2 inches each.

As shown in these figures, integrally formed within the web 2 are elongated reinforcing means of solid cross-section having a generally straight longitudinal axis oriented generally parallel to the flanges 4,6. In this embodiment of the invention, the reinforcing means consist of two transversely enlarged ribs 20,22. These ribs are preferably coextensive with web 2. The ribs 20 preferably project in a symmetrical fashion on both sides of the web 2 and may have a width Y equal to about 200 to 400 percent of the thickness of the web 2 and preferably about 275 to 325 percent. The rib height X measured along said web is about 0.5 to 1.5 inches and preferably about 0.75 to 1.25 inches. It is preferred that within the region 12 of the web, disposed between regions 10 (having dimension F) and 14 (having dimension G) of the web, about one to five such ribs will be provided. The mass of the ribs will be selected such that they will serve as a heat sink to absorb sufficient heat that the temperature differential between the web 2 and the flanges 4,6, during hot roll forming, will be minimized to the point where, upon cooling, there will be resistance to waviness being established within the web 2 due to the temperature differential.

In the form shown, the ribs 20,22 have curved exterior configurations and may approximate a sphere. It will be appreciated that, if desired, other configurations, such as elliptical and hexagonal may be employed.

Figure 3:
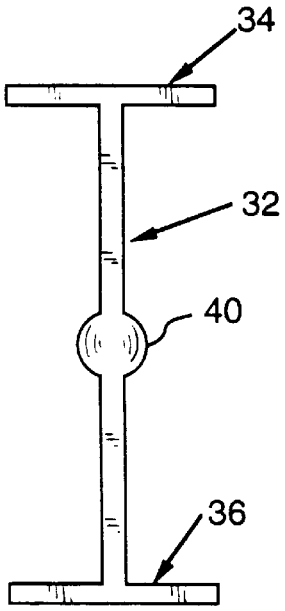
FIG. 3 is an end elevational view of another embodiment of the I-beam of the present invention.
Figure 4:
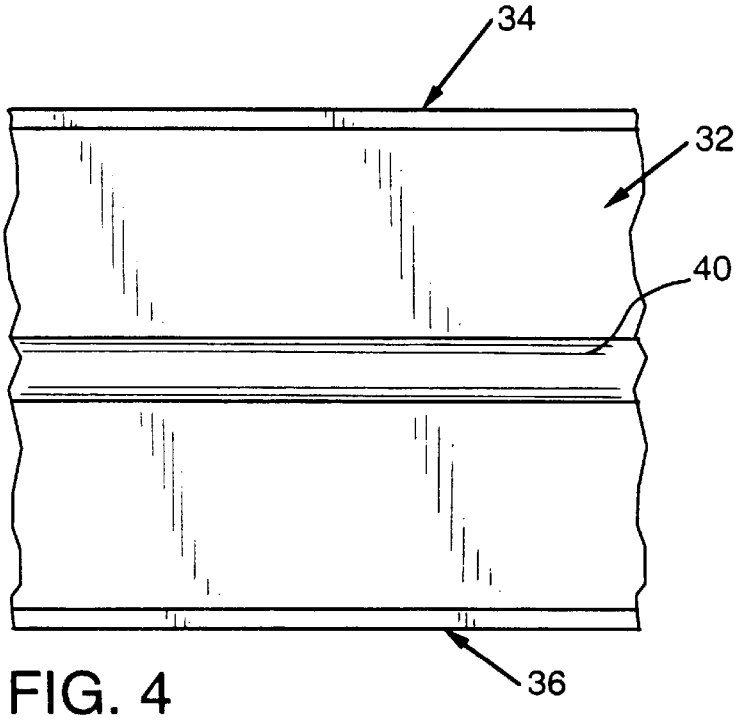
FIG. 4 is a partial illustration of a right side elevation of the I-beam of FIG. 3.
Figure 5A:
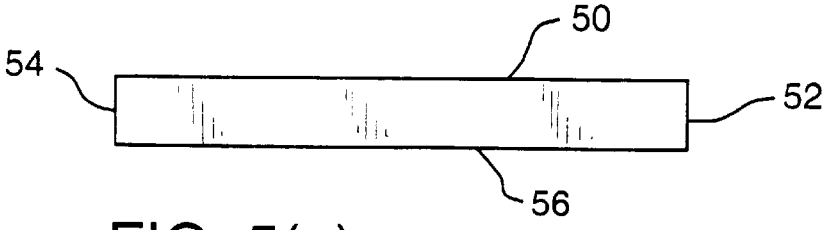
FIGS. 5*a–d* are schematic illustrations of one embodiment of the manufacture of an I-beam of the present invention.
Figure 5B:
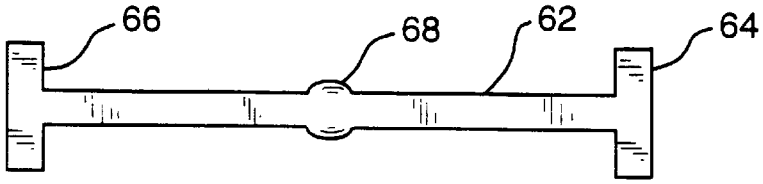
Figure 5C:
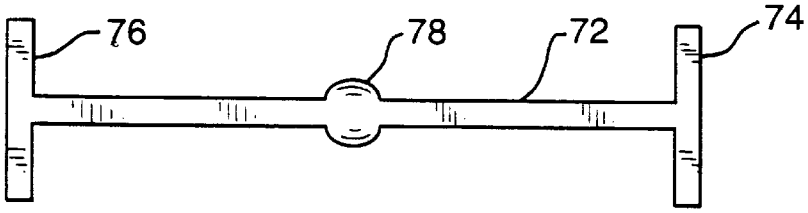
Figure 5D:
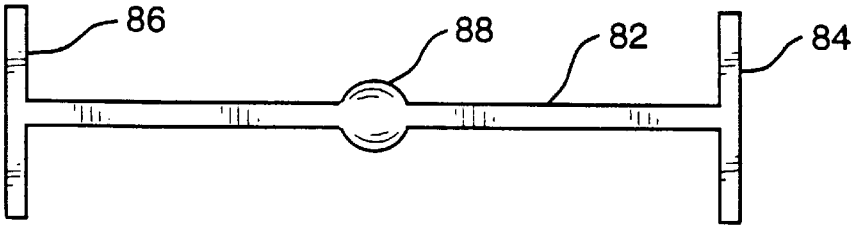

Referring to FIGS. 3 and 4, a different embodiment of the invention is shown. A web 32 is integrally formed with a pair of flanges 34,36 and a single elongated reinforcing rib 40 is provided. In general, the rib 40 may be of larger solid section than either of the individual ribs 20,22 in FIGS. 1 and 2, in order to provide an adequate metal heat sink to minimize the heat differential due to roll forming. If desired, three or more ribs could be provided, each being proportionately smaller.

I-beams of the present invention may be employed in a conventional manner in a load bearing capacity in buildings or other structural products, in whatever lengths, widths, interconnection and support postures that conventional I-beams would be employed. As such uses are too numerous to list exhaustively herein and those skilled in the art would readily know how to employ the same, details regarding such use are not provided herein. For example, it is known to secure the ends of I-beams in masonry supporting walls which are ultimately supported by the foundation of small buildings with floors or other load creating elements of the building being supported thereon. It is also known to employ a plurality of such beams, such as a number duly supported and oriented perpendicularly with respect to each other and being interconnected to cover a large area where load bearing support is required or desired. The I-beams may be oriented in any desired position.

Referring to FIGS. 5(*a*)–5(*d*), an example of the method of the present invention employed in hot rolling a steel I-beam having a single reinforcing rib in a multiple roll forming process will be considered. As those skilled in the art will readily know how many stages and what roll configurations to employ for a particular design, such details need not be provided herein. In general, more hot rolling stages would be employed and FIGS. 5(*a*) through (*d*) should be regarded as being illustrative as depending upon the metal, its properties and the desired dimensions, different numbers of roll stands may be employed.

FIG. 5(*a*) shows a workpiece which is an elongated steel billet having an upper surface 50, lateral surfaces 52,54 and a lower surface 56. The material may be a mild carbon steel alloy and have a thickness of about 2 to 10 inches.

After the first stage of forming, as shown in FIG. 5(*b*), the workpiece will have a web 62 and a pair of flanges 64,66 which are integrally formed therewith and a reinforcing rib 68. The second stage of hot rolling thins the web to create web 72, provides generally centrally disposed reinforcing rib 78 and has elongated and thin flanges to provide flanges 74,76. The final stage I-beam is shown in FIG. 5(*d*) wherein the web 82 has flanges 84,86, which flanges are of equal size, and the reinforcing rib 88. As with other embodiments of the invention, the I-beam will have a substantially uniform cross-sectional configuration throughout its longitudinal extent.

It will be appreciated that the method and product of the present invention result in a hot rolled I-beam which is substantially devoid of undesired waves in the web portion of the beam caused by temperature differential between the web and the flanges during cooling. This is accomplished through providing longitudinally oriented reinforcing means which have a longitudinal axis generally parallel to the flanges. These reinforcing means which may take the form of about one to five ribs in a preferred embodiment serve as heat sink to cause the web to absorb additional heat and thereby narrow the difference in average temperature between the web and flanges prior to cooling such that buckling or waviness in the web caused by cooling is resisted.

The I-beam of the present invention may be employed in various load bearing building installations in the manner that conventional I-beams may be employed. The proportions of web, flanges and ribs are such that as compared with prior art I-beams, it may provide lighter weight per linear foot with equal or greater strength and be substantially devoid of undesired web waviness due to temperature differences between the web and flanges.

It will be appreciated that, while for convenience of disclosure herein, metal I-beams, which are composed of mild carbon steel, have been disclosed, the invention is not so limited and various types of metals, such as aluminum and high strength, low alloy grade steel may be employed, if desired. Also, in the context of use, while the primary use will be in terms of load bearing horizontally oriented building installations of the I-beams, the beams may be employed in various horizontal, vertical or angular positions, and for various additional purposes.

Whereas particular embodiments of the invention have been described herein for purposes of illustration, it will be evident to those skilled in the art that numerous variations of the details may be made without departing from the invention as defined in the appended claims.

What is claimed is:

1. A structural product comprising said structural product having a plurality of hot-rolled I-beams secured in fixed relationship with respect to the other said I-beams with each said I-beam having a substantially continuous web, a pair of flanges disposed at opposite edges of said web, integrally formed elongated reinforcing means of solid cross-section being generally straight and extending continuously longitudinally generally parallel to said flanges, said reinforcing means having two to five elongated laterally projecting ribs, said web having generally continuous planar portions connecting said ribs and said flanges continuously, said web being substantially devoid of waves caused by temperature differential between said web and said flange prior to cooling, and said I-beam having a substantially uniform cross-sectional configuration throughout its longitudinal extent.

2. The structural product of claim 1 including said ribs having a maximum width of about 200 to 400 percent of the average width of said web.

3. The structural product of claim 2 including said elongated laterally projecting ribs being substantially coextensive with said web.

4. The structural product of claim 2 including said ribs having a height measured along said web of about 0.5 to 1.5 inches.

5. The structural product of claim 1 including said structural product being a building, and said building having external walls and an overlying roof.

* * * * *

UNITED STATES PATENT AND TRADEMARK OFFICE

CERTIFICATE OF CORRECTION

PATENT NO. : 6,219,990 B1 
DATED : April 24, 2001
INVENTOR(S) : Carl A. Snyder et al.

It is certified that error appears in the above-identified patent and that said Letters Patent is hereby corrected as shown below:

Title page,
Item [62], add continuing data -- This is a Division of Application No. 08/818,476, Mar. 14, 1997 --.

Signed and Sealed this

Eighteenth Day of June, 2002

*Attest:*

JAMES E. ROGAN
*Director of the United States Patent and Trademark Office*

*Attesting Officer*